United States Patent [19]

Rasmussen

[11] Patent Number: 4,640,661

[45] Date of Patent: Feb. 3, 1987

[54] VACUUM LIFT CLAMP DEVICE FOR HANDLING OF PAPER ROLLS

[76] Inventor: Rolf B. Rasmussen, Niels Høegs vei 33C, N-2010 Strømmen, Norway

[21] Appl. No.: 598,311

[22] PCT Filed: Jul. 4, 1983

[86] PCT No.: PCT/NO83/00027

§ 371 Date: Feb. 28, 1984

§ 102(e) Date: Feb. 28, 1984

[87] PCT Pub. No.: WO84/00154

PCT Pub. Date: Jan. 19, 1984

Related U.S. Application Data

[63] Continuation-in-part of Ser. No. 394,803, Jul. 2, 1982, abandoned.

[51] Int. Cl.[4] ..... B66F 9/18

[52] U.S. Cl. ..... 414/619; 414/623; 414/627; 414/911; 294/64.1

[58] Field of Search ..... 414/618, 619, 623, 627, 414/911; 294/64 R, 65

[56] References Cited

U.S. PATENT DOCUMENTS

| | | | |
|---|---|---|---|
| 3,147,872 | 9/1964 | Olson | 414/627 X |
| 3,227,482 | 1/1966 | Harris et al. | 414/627 X |
| 3,260,391 | 7/1966 | Horton | 414/618 |
| 3,260,392 | 7/1966 | Harris | 294/65 |
| 3,276,611 | 10/1966 | Horton | 414/627 |
| 3,363,929 | 1/1968 | Nelson | 414/619 X |
| 3,367,705 | 2/1968 | Ames | 414/627 X |
| 3,982,782 | 9/1976 | Bos | 414/627 X |

*Primary Examiner*—Robert J. Spar
*Assistant Examiner*—Ken Muncy
*Attorney, Agent, or Firm*—Larson & Taylor

[57] ABSTRACT

A vacuum lift clamp device for sidehandling of one or two paper rolls (21), for use in connection with ordinary fork lift trucks equipped with a vacuum pump device (23), and having a curved carrying plate (1, 2, 3) e.g. of steel, supporting the vacuum pad (6) which has a rubber sealing member in front for vacuum tight engagement against the paper rolls, consisting of three curved parts hinged together by means of two vertical hinges for adapting the vacuum pad positively to various roll diameters, the weight of the paper roll being carried by means of a horizontal rolling ball system (7, 26, 27, 28, 34) located at the upper rear side of the curved center pad plate (2) and partly connected thereto and partly to the fork lift truck lift mast carriage (8) enabling the vacuum pad to be correctly turned against a paper roll having been placed arbitrarily in front of the truck, the necessary horizontal pressure of the rubber sealing being transferred from the truck and close to the center of each of the two outer pad plate parts (1, 3), by means of mechanical balance arm (30).

11 Claims, 12 Drawing Figures

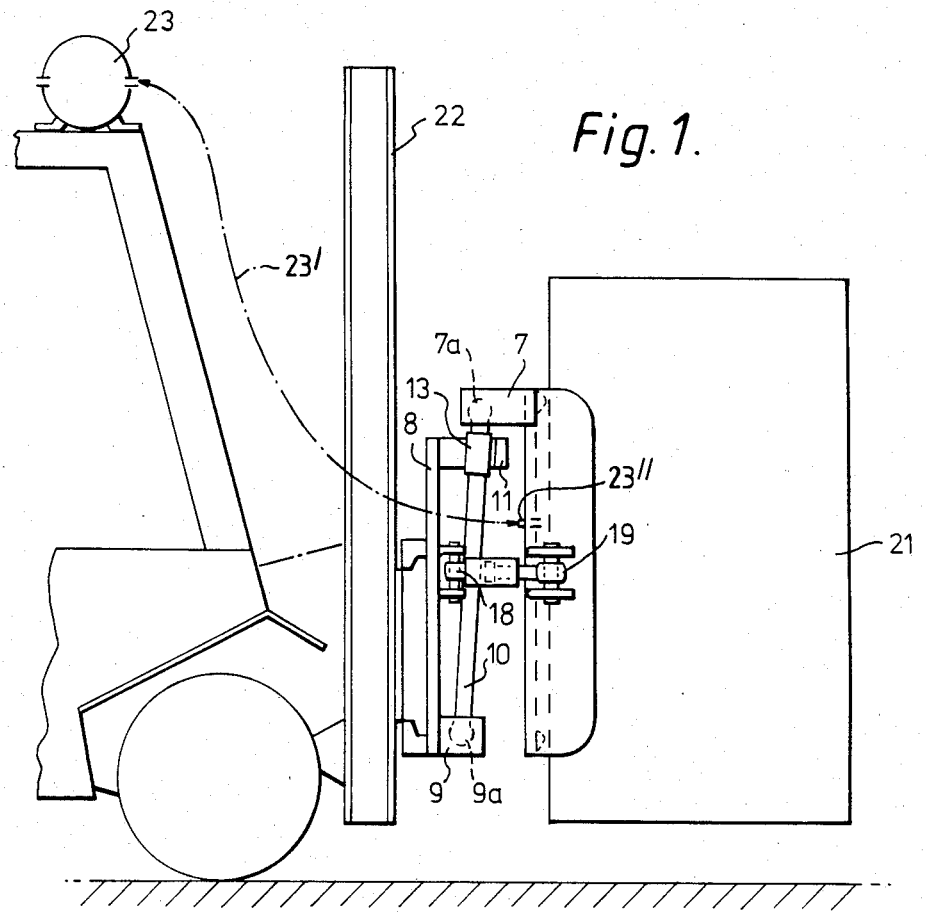
Fig. 1.
Fig. 2.
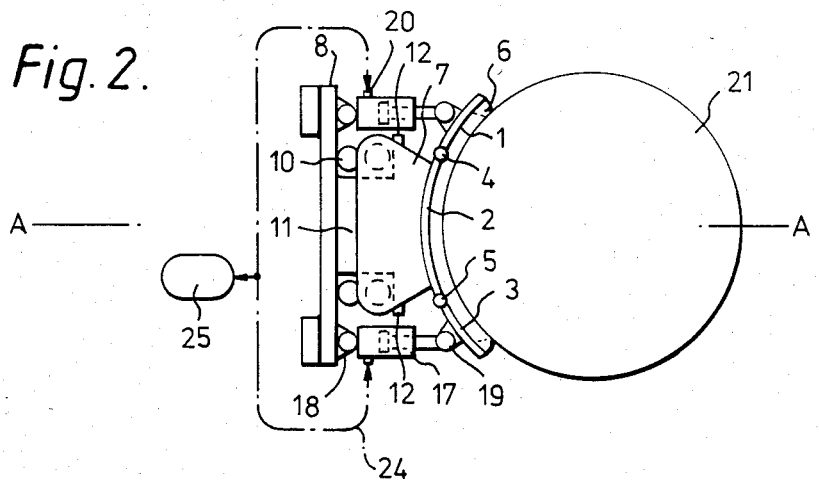

VACUUM LIFT CLAMP DEVICE FOR HANDLING OF PAPER ROLLS

This application is a continuation-in-part application of Ser. No. 394,803, filed July 2, 1982, now abandoned.

The present invention is related to clamp lift truck handling of primarily news print paper rolls. On its way from the paper mill to the news print machinery each paper roll has to be handled by clamp lift trucks several times. Based on experience all over the world, there is a small—but definite—risk of damaging the rolls during each handling. Experience also points out the considerable lower risk by using vacuum lift clamps instead of the conventional type of clamps having pressure pads.

Vacuum lift clamps for news print rolls have been used for many years—mostly in the United States—with both good and bad results, and represent in their basic principles no novelty. The few vacuum clamp types on today's market, however, are constructions based on old ideas concerning the design of the vacuum pads and their bearing systems, and have not been adapted to the various sizes of rolls in use today, or those that may come in the future.

It is an object of the present invention to enable the truck driver to handle a single paper roll, alternatively two rolls side by side, with various diameters within a range from 30" to 45" or 50", in the easiest and most safe manner. Furthermore, the present invention has an object to provide a very simple and durable vacuum clamp construction which is easy and inexpensive to manufacture and to do maintenance on.

According to the invention, each vacuum pad unit consists of three rigid curved plate parts, preferably of steel, hinged together by means of two vertical hinges, in order to adapt the rubber sealing in front of the pad plates positively to the various diameters of the paper rolls. Supporting means between the vacuum pad(s) and the fork carriage on the lift mast provide the three curved pad parts with free movement for their adaption to varying diameters of the paper roll types, and also free movement for adaption of the pad to various positions of the roll(s). The supporting means provides a favourable pressure distribution to all lengths of the rubber sealing, with special attention to the vertical parts of the sealing, which—based on experience—are difficult to seal because of the horizontal waved rings that often exist on the surface of the rolls, caused by moisture. A favourable pressure distribution will occur both when picking up the rolls and after having lifted them. This is attained as defined in the characterizing clause of the attached patent claims.

Four preferred non-limitative embodiments of the invention are described in detail hereafter, with reference to the accompanying drawings, where FIG. 1 illustrates a first embodiment of the invention, having a vacuum lift clamp for side handling of a single paper roll;

FIG. 2 is a top view of the embodiment according to FIG. 1;

Figure 11:
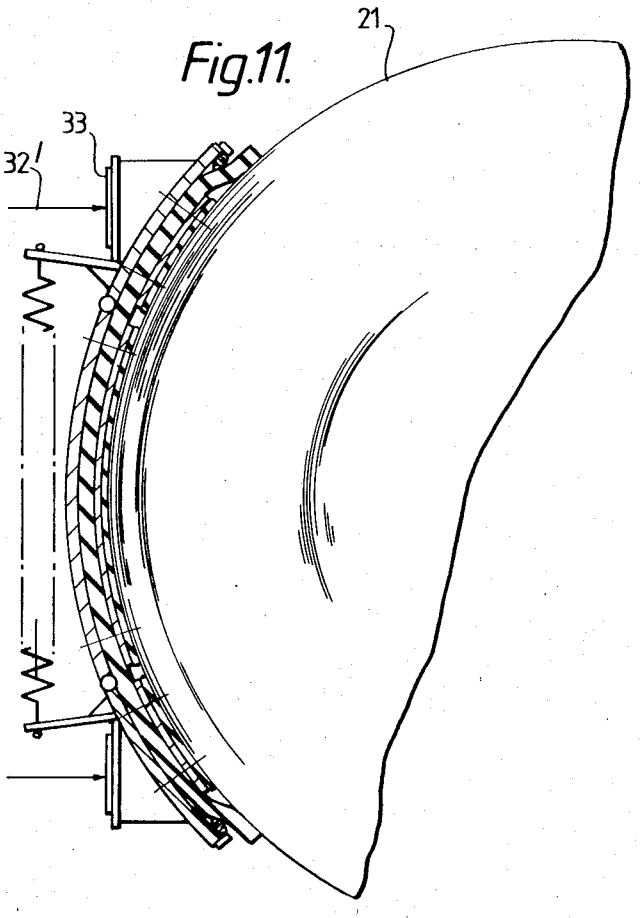
Figure 10:
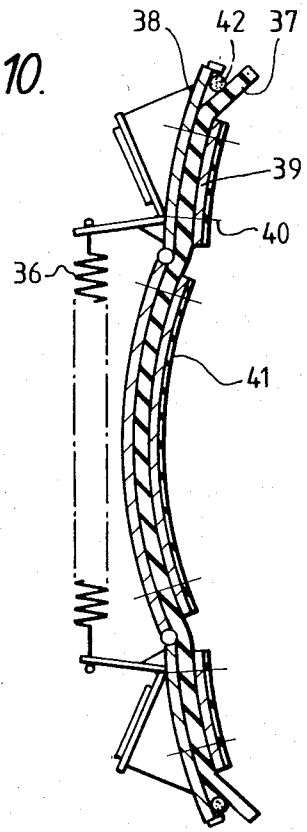

The further FIGS. 10 and 11 illustrate the construction and operation of a preferred vacuum pad—to be described—for use with any of the four embodiments.

Figure 12:
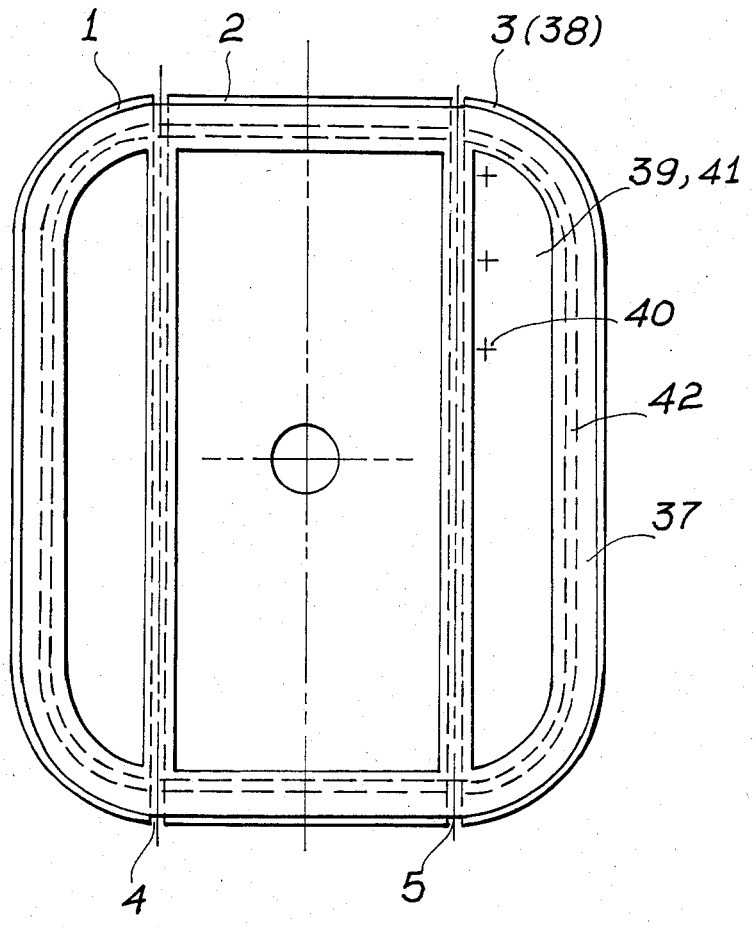

FIG. 12 is a front view of FIG. 11.

The three curved vacuum pad plates 1,2 and 3 including a central plate and two outer flap plates are hinged together along vertical hinges 4 and 5. On the paper roll side of the pad there is a rubber sealing member 6, not being shown in details on the FIGS. 1–7, because such sealing members are well known in the art in various designs on vacuum lift clamps.

A bearing member, shown herein as a female upper ball joint bearing 7 is attached to the top of the middle pad plate 2, and a support member, shown herein as a female lower ball joint bearing 9 is attached to the bottom of a frame member operatively connected to the truck, shown herein as a main carrying plate 8. Two lifting rods 10 for each pad have a ball joint male part at each end, and are disposed almost vertically, connecting the upper and lower ball joint female parts 7 and 9. The two lifting rods 10 are bearing against a stop bar 11 being fastened to the top of the main carrying plate 8. Each lifting rod is protected by a nylon bushing 13 at the point of contact with the stop bar 11. These elements therefore form a universal connection between the support member and the frame member.

On the single clamp version FIGS. 1 and 2, two mutually aligned stop means 12 are provided on the stop bar 11. Thereby the two lifting rods 10 will each have equal maximum forward angle relative to the vertical when the nylon bushings 13 abut said stop means 12 on the stop bar 11. On the double clamp version according to FIGS. 3 and 4 outward lateral movement stop means 14 are provided which are not quite on line with inward lateral movement stop means 15, and thereby the four lifting rods 10 will assume different angles relative to the vertical when both nylon bushings 13 abut the stop bar 16.

A balance arm is arranged between the main carrying plate 8 and the outer, flap plates. As shown herein, the balance arm comprises, between the carrying plate 8 and each of the two outer pad parts 1 and 3 a horizontal hydraulic cylinder 17 with universal ball joints 18 and 19 at both ends. The hydraulic fluid outlets 20 on the two cylinders in FIGS. 1 and 2—alternatively four cylinders in FIGS. 3 and 4—are interconnected directly together with flexible hydraulic lines 24 and the space in the cylinders and lines is completely filled with hydraulic oil.

Before touching the paper roll 21, the single pad in FIGS. 1 and 2 will lean forward at a small angle, and both nylon bushings 13 will bear against the two stop means 12 on the stop bar 11. The pistons of the two hydraulic cylinders 17 will be in equal positions. When the truck 22 is being driven against the paper roll, one of the upper edges of the vacuum pad will hit the roll. The vacuum pad will then first be shifted to a position parallel to the vertical axis of the roll, through turning about ball joints 19 connecting said pad with the hydraulic cylinder 17. By this movement the two lifting rods 10 will be moved backwards about the ball joints 9, 9*a* to a more vertical position, and both of the nylon bushings 13 will thus leave the stop bar 11.

The vacuum pad will then be turned horizontally about the ball joints 7, 7*a* until both outer pad parts 1 and 3 are touching the roll. During this movement, oil will be pressed from one cylinder to the other, and the cylinder pistons and also the lift rods will stop in different positions, depending on how much the centre line of the truck is out of line with the paper roll central axis.

Reaching this position, the truck driver can press the vacuum pad slightly against the roll. The horizontal forces from the truck will be transferred to the vacuum pad by the two cylinders 17 only, in correct direction and correct spots on the pad to provide excellent pressure distribution over all lengths of the rubber sealing, special attention being made to the vertical parts of the outer pads. The vacuum pump 23 on the truck now will evacuate completely the air from within the pads, and the clamp is ready to lift the roll. Upon lifting-up of the roll, the pad will assume the same "slightly-forward"-position it had before touching the roll. The bearing of the two lift rods 10 against the symmetrical stop bar 11 will bring the paper roll to the centre line of the truck, and keep it there during the driving thereof. By tilting the lift mast of the truck to the same but backward angle, the roll will obtain vertical position during the driving.

The working principle of the double vacuum clamp is similar to what is being described for the single clamp, with exception of the function of the stop bar 16. Because of the asymmetrical design of the stop means 14 and 15, the two pads on the double clamp will be turned towards the centre line A—A of the truck. If the two pads are empty, they will both turn against each other until the nylon bushing 13 reaches the stop means 15. This characteristic results in that the two paper rolls, after having been lifted up, will be moved automatically together until their surfaces are in touch.

A hydraulic accumulator 25 may be connected to the cylinders to provide a bufferspring action in order to reduce the forces of the clamp upon a possible hard driving against the paper roll(s).

As previously stated, the basic principle of the present invention is based on the three-part vacuum pad, consisting of three curved parts being hinged together by two vertical hinge means, and a supporting means between the vacuum pad and the fork carriage on the lift mast, the said supporting means enabling the curved centre pad plate to handle the vertical force component and the two curved outer pad plates to handle horizontal force component, thus enabling good sealing on paper rolls having different diameters.

Figure 3:
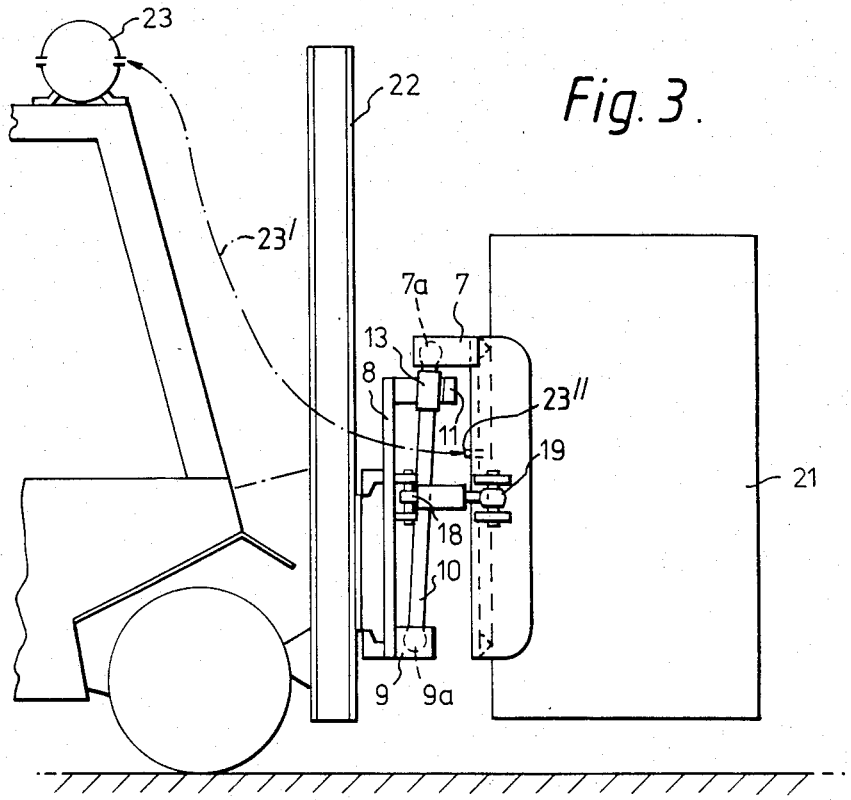
FIG. 3 illustrates a second embodiment according to the invention enabling the handling of two paper rolls side by side.
Figure 4:
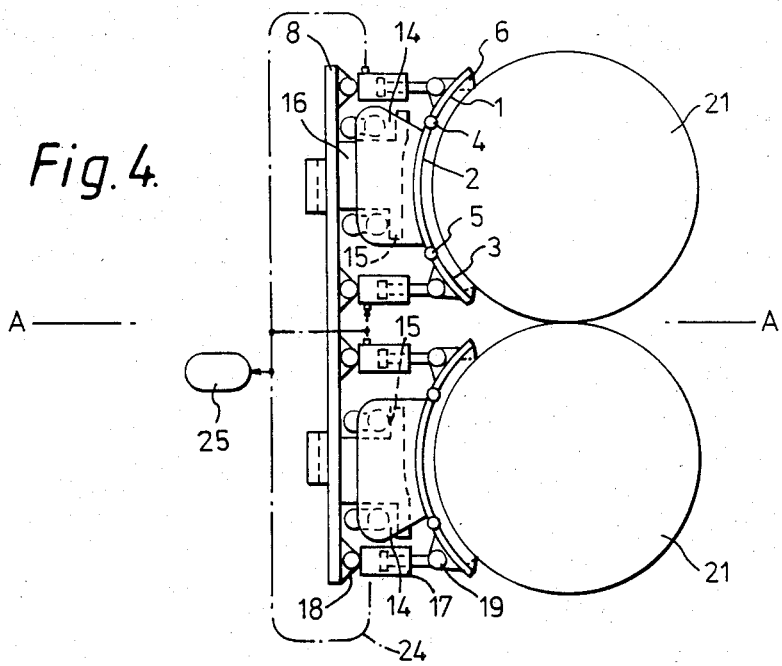
FIG. 4 is a top view of the embodiment according to FIG. 3.
Figure 5:
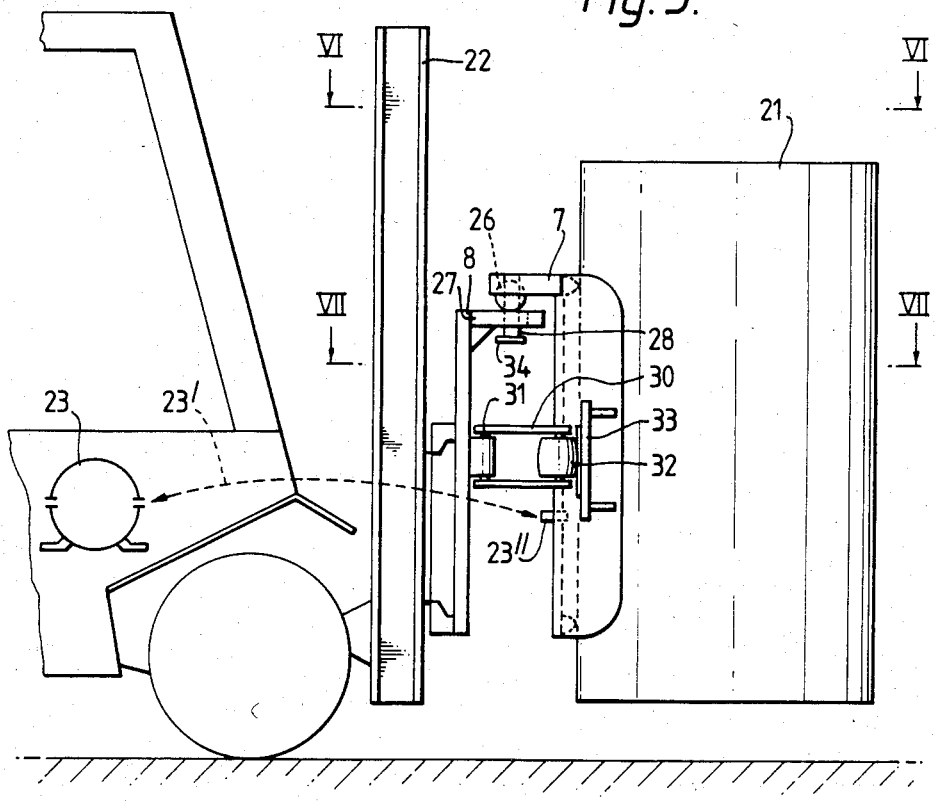
FIG. 5 illustrates a third embodiment of the invention being considered as the best mode.
Figure 6:
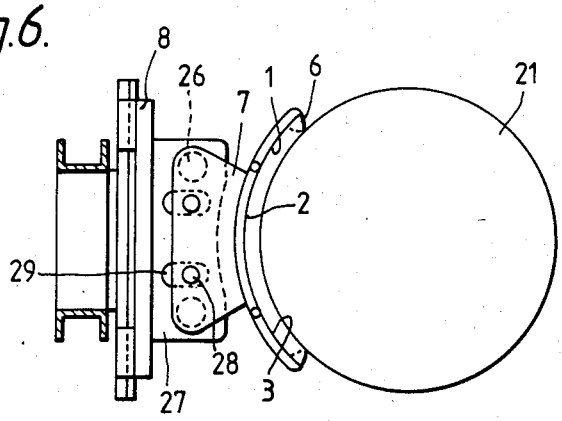
FIG. 6 is the view VI—VI in FIG. 5 but wherein details of the balance arm (shown in FIG. 7) are eliminated for purposes of clarity.
Figure 7:
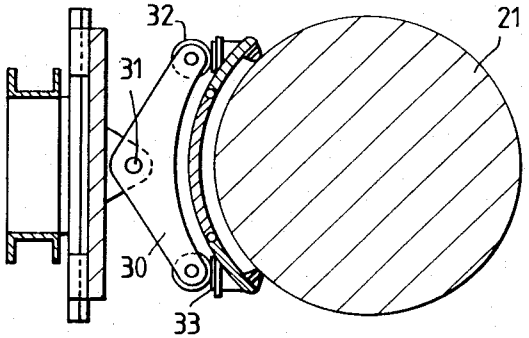
FIG. 7 is the view VII—VII in FIG. 5.

As indicated in FIGS. 5–7, an alternative design of the supporting means is provided by using a horizontal rolling ball universal connection system at the top of the curved centre pad plate—instead of the vertical lift rods—and a mechanical balanced arm system in connection with the two curved outer pad plates, instead of the hydraulic balance arm system having hydraulic cylinders.

The third preferred non-limitative embodiment of the invention is described below with reference to FIGS. 5–7.

The rolling ball universal connection system consists of at least two balls 26 of steel having their bearings located in the bearing member 7 and are rolling on the top face of a support member in the form of a lower bearing member 27, said members 7 and 27 being plates, and the member 27 preferably being provided with an upper lining of hardened steel or other suitable material designed to withstand the point-like forces from the steel balls. Two supporting bolts 28 are fastened to the top bearing plate member 7 and are respectively slidable in two oblong slots 29, provided in the lower member 27. The bolts extend, as indicated in FIG. 5, slightly below the plate member 27 and are prevented from jumping out of the slots 29 by means of a stop member 34. Said stop member 34 may suitably be located on the individual bolt 28 or be in the form of a rod or the like extending between the bolts 28 below the plate member 27.

The mechanical balanced arm system consists of a balance arm 30, turnably hinged at bearing 31 and through said bearing being fastened to the main carrying plate 8, and the forward ends being provided with two rollers 32, as clearly shown in FIG. 7.

Before touching the paper roll 21, the pad of FIGS. 5–7 will lean forward at a small angle relative to the vertical, the supporting bolts 28 thus bearing against the forward end of the respective slots 29. The two curved outer pad plates 1 and 3 will bear against the two rollers 32, as clearly shown in FIG. 7.

When the truck 22 is driven against the paper roll 21, one of the upper edges of the vacuum pad will hit the roll 21. The vacuum pad will then first be shifted to a position parallell to the vertical axis of the roll, and also turned horizontally until correct position against the roll surface is obtained, said movements being provided by aid of the horizontal movement of the balls 26 and sliding of the bolts 28 in the slots 29.

Reaching the position, the truck driver can press the vacuum pad slightly against the paper roll. The horizontal forces from the truck will be transferred to the vacuum pad by the balance arm 30 only, in correct direction and correct spots on the pad to provide excellent pressure distribution over the full dimensions of the rubber sealing 6, special attention being made to the vertical parts of the two outer pad parts 1 and 3.

Otherwise, the system according FIGS. 5–7 will operate as described earlier with reference to FIGS. 1–2. Thus the vacuum pumps 23 will be linked with the pads as indicated by the air hose 23' and the pad fitting 23''.

By the embodiment according to FIGS. 5–7 the hydraulic cylinders 17, the hydraulic lines 24 and the hydraulic accummulator 25 of FIGS. 1–4 are avoided. The embodiment according to FIGS. 5–7 is therefore considered to be the best mode of the invention.

In the embodiment of FIGS. 5–7, a rubber buffer 33 may be mounted between the rollers 32 and the outer pad parts 1 and 3 to reduce the forces of the clamp upon possible accidental hard driving against the paper roll.

Figure 9:
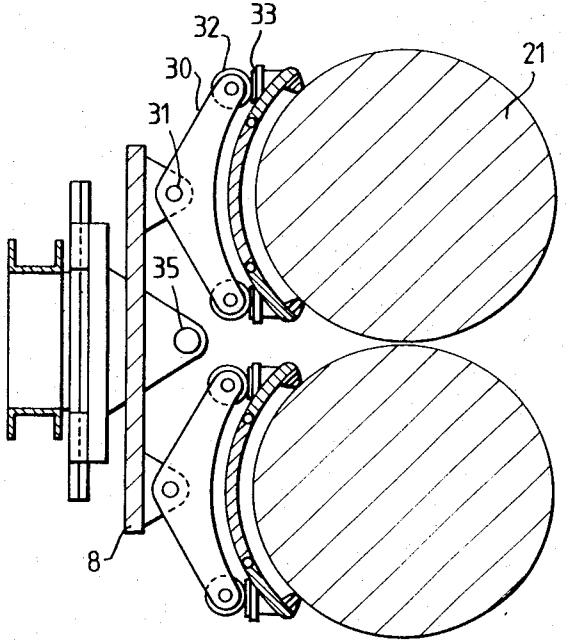
FIGS. 8 and 9 illustrates a fourth embodiment of the invention enabling the handling of two paper rolls side by side, the view being similar to the views in FIGS. 6 and 7, respectively.
Figure 8:
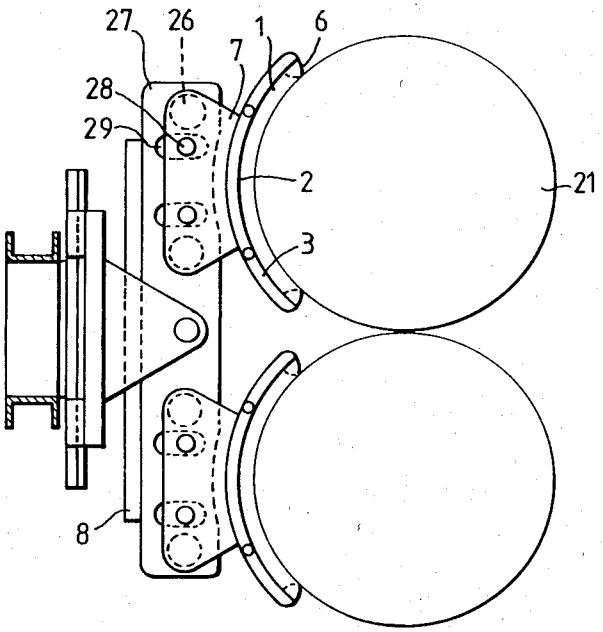

The rolling ball-/balance arm system can also be used for the design of a vacuum clamp for the handling of two paper rolls side by side, see FIGS. 8 and 9. In this embodiment, the main carrying plate 8 is common for the two vacuum pad systems, and made turnable thorugh a limited angle by means of a common bearing 35.

The vacuum pad will hit the paper roll surface with most gentleness when the outer pad parts 1 and 3 are turned into a backward position relative to the centre pad parts 2 in the moment of touching. The balanced arm system will immediately bring the outer pad parts into correct position by means of the rollers 32. This feature can be attained by mounting a horizontal coiled spring 36 between the two outer pad parts. FIGS. 10 and 11 illustrate the mounting of the spring 36 and also the position of the pad before the paper roll is touched (FIG. 10) and after the paper roll is touched (FIG. 11).

As mentioned before, the vacuum pad system according to the present invention can be used in connection with already known types of rubber sealings existing on the market. However, all types of sealings that have been and are presently in use are manufactured as form shaped rubber sealings of different designs. However, the form press shaping process makes the sealing very expensive and difficult to vary in dimensions.

A new simple type of rubber sealing system is provided according to the invention based on the use of a conventional rubber sheet and a string of e.g. soft foamed rubber or its equivalent, as indicated in FIGS. 10 and 11 and 12. The main rubber sealing sheet 37 is of standard rubber sheet quality and is pressed against the basic pad plate 38 by the front press plates 39 and screws 40 (indicated by a thin line). A rubber friction sheet 41 is vulcanized on the front press plates 39. The resilient string 42 of e.g. soft foamed rubber provides the rubber sealing sheet 37 with a perfect form along its periphery for sealing engagement against the paper roll surface, and also provides seal spring action in addition to the inherent seal spring action of the rubber sheet 37 itself. The two arrows 32' represent this force from the rollers 32 in the balanced arm system, as indicated in FIGS. 7 and 9.

I claim:

1. A vacuum lift clamp device for handling at least one paper roll, for use in connection with a conventional lifting truck, comprising:

a frame member operatively connected to the truck, a support member connected to the frame member, a vacuum pad unit comprising a rigid curved central plate and two rigid curved, outer flap plates hingedly connected, one to each vertical edge of the said central plate, whereby movement of the flap plates about their said hinge connections to the central plate permits the vacuum pad to adapt to different diameter paper rolls, sealing means on the faces of said plates for forming an evacuatable vacuum tight area between the plates and the roll, after the plates have been placed against a roll, for holding the roll to the plates, a bearing member connected to the upper rear part of said central plate, a universal connection means between said support member and said bearing member for supporting the vertical forces exerted by the vacuum pad and by a roll held thereon, while permitting fore and aft tilting movement and limited turning movement, of the bearing member, and hence also the upper part of the vacuum pad, relative to said frame member, a force exerting balance arm operatively connected between said frame member and each of said flap plates, said balance arm engaging said flap plates at a height sufficiently below the height of the bearing member to exert a tilting forward torque effect on the paper roll which tends to urge the lower part of the roll forwardly relative to the upper part of the roll located adjacent the bearing member, said balance arm having means for substantially increasing, in three stages, the horizontal forces which it exerts against said flap plates, the first and lowest force stage being attained by the rearward movement of the upper part of the roll, relative to the vacuum unit, upon forward movement of the truck against a roll, the second and medium force stage being attained by the forward horizontal turning movement of the two flap plates into a sealing position against the roll upon further forward movement of the truck, and the third and highest force stage being attained by the lifting movement of the paper roll, whereby, as the truck moves the vacuum pad unit forwardly against a roll, in the said first stage the upper part of the roll moves the upper part of the vacuum pad rearwardly towards the truck until vertical parallelism is attained between the vacuum pad unit and the roll surface, and at the same time turns the vacuum pad unit horizontally until symmetry is attained between the vacuum pad unit and the roll surface, followed by the said second stage, in which the two flap plates are turned forwardly against the roll surface into correct sealing position, caused by increasing horizontal forces transferred from the truck's forward movement force via the balance arm, further followed by the said third stage that occurs in the lifting moment, in which said tilting forward torque effect of the paper roll in a lifted position is converted by the flap plates, via the balance arm, into a substantial additional flap plate closing torque, the said third stage giving an essentially higher sealing pressure to the sealing rubber on the flap plates then would be caused by the vacuum alone, and also attaining a mechanical clamping effect in addition to the holding force caused by the vacuum.

2. A vacuum lift clamp device according to claim 1, said universal connection means comprising flat opposing horizontal surfaces of said support member and said bearing member and rolling ball means between and engaging said opposing surfaces, and including at least one elongated slot in one of said surfaces extending in the fore and aft direction, and an elongated rod attached to and extending from the other surface and entering into the slot, said slot and rod permitting limited fore and aft movement of the bearing member, relative to the support member, while also permitting limited turning of the bearing member about a vertical axis relative to the frame member.

3. A vacuum lift clamp device according to claim 2, said rolling ball means comprising a plurality of rolling balls, arranged symetrically about a fore and aft center line of the vacuum pad, and including a pair of said slots in the support member, and a pair of said rods extending downwardly from said bearing member, one into each said slot.

4. A vacuum lift clamp device according to claim 2, said force exerting balance arm pivotally connected to the frame member for movement about a vertical axis, said force exerting arm being symetrical about the fore and aft center line of the vacuum pad, the opposite ends of the balance arm facing forwardly and operatively engaging said flap plates, whereby upon forward movement of the truck, urging the vacuum pad against a roll, the balance arm forces the two flap plates tightly against the roll.

5. A vacuum lift clamp device according to claim 2, said force exerting balance arm comprising a pair of interconnecting hydrualic piston and cylinder units, each engaging the frame member at its rearward end, and one engaging each flap plate at its forward end.

6. A vacuum lift clamp device according to claim 1, said universal connection means comprising a pair of upright lifting rods resting at their lower ends on the support member and supporting the bearing member, guide means connected to the frame member for guiding said rods to allow limited forward and aft movement thereof and more limited turning movement of the bearing member, and hence also the vacuum pad, relative to the frame member.

7. A vacuum lift clamp device according to claim 6, said force exerting balance arm comprising a pair of interconnecting hydrualic piston and cylinder units, each engaging the frame member at its rearward end, and one engaging each flap plate at its forward end.

8. A vacuum lift clamp device according to claim 7, including a hydraulic accumulator in the interconnection between said hydraulic cylinders, said hydrualic accumulator comprising a means for buffering the force of the arms upon engagement of the vacuum pad against a paper roll.

9. A vacuum lift clamp according to claim 1, said sealing means on the said rigid curved plates comprising a generally flat rubber-like sheet, said sheet forming sealing areas for airtight engagement of the curved surfaces of the plates with a paper roll, and including a string of resilient material located about the periphery of the vacuum pad, between the rubber-like sheet material and the rigid plates themselves, said string of resilient material enhancing the sealing effect when the vaccum pad is placed against a roll.

10. A vaccum lift clamp according to claim 9, including front press plates connected to the exposed surface of the rubber-like sheet and pressing it against the said rigid curved plates.

11. A vacuum lift clamp according to claim 1, including a pair of said lift clamps mounted side-by-side in connection with a conventional truck.

* * * * *